US007698143B2

(12) United States Patent
Ramakrishnan et al.

(10) Patent No.: US 7,698,143 B2
(45) Date of Patent: Apr. 13, 2010

(54) CONSTRUCTING BROAD-BAND ACOUSTIC SIGNALS FROM LOWER-BAND ACOUSTIC SIGNALS

(75) Inventors: Bhiksha Ramakrishnan, Watertown, MA (US); Paris Smaragdis, Brookline, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 1366 days.

(21) Appl. No.: 11/130,735

(22) Filed: May 17, 2005

(65) Prior Publication Data

US 2006/0265210 A1 Nov. 23, 2006

(51) Int. Cl.
*G10L 19/00* (2006.01)
*G10L 19/02* (2006.01)

(52) U.S. Cl. ..... 704/500; 704/204; 704/205

(58) Field of Classification Search ..... 704/234, 704/244, 204, 205, 500
See application file for complete search history.

(56) References Cited

U.S. PATENT DOCUMENTS

| | | | | |
|---|---|---|---|---|
| 5,581,652 | A * | 12/1996 | Abe et al. | 704/222 |
| 5,978,759 | A * | 11/1999 | Tsushima et al. | 704/223 |
| 7,181,402 | B2 * | 2/2007 | Jax et al. | 704/500 |
| 2003/0050786 | A1 * | 3/2003 | Jax et al. | 704/500 |
| 2003/0093278 | A1 * | 5/2003 | Malah | 704/265 |
| 2005/0267739 | A1 * | 12/2005 | Kontio et al. | 704/205 |

OTHER PUBLICATIONS

Sven Behnke, Discovering hierarchical speech features using convolutional non-negative matrix factorization, 2003, Proceedings of International Joint Conference in Neural Networks, vol. 4, pp. 2785-2763.*

Pedro Crespo, Computer Simulation of Radio Channels Using a Harmonic Decomposition Technique, Aug. 1995, IEEE, vol. 44. No. 3 , pp. 414-419.*

Hsu, "Robust bandwidth extension of narrowband speech", Thesis, McGill University, Canada, Nov. 2004.*

Yasukawa, H. "Signal Restoration of Broad Band Speech Using Nonlinear Processing," Proc. European Signal Processing Conf. (EUSIPCO-96), pp. 987-990, 1996.

Chennoukh, S., Gerrits, A., Miet, G. and Sluijter, R., "Speech Enhancement via Frequency Bandwidth Extension using Line Spectral Frequencies," Proc ICASSP-95, 2001.

Lee, D.D and H.S. Seung. "Learning the parts of objects with non-negative matrix factorization," Nature 401, p. 788-791, 1999.

P. Smaragdis, "Discovering Auditory Objects Through Non-Negativity Constraints," SAPA 2004, Oct. 2004.

* cited by examiner

*Primary Examiner*—Richemond Dorvil
*Assistant Examiner*—Jialong He
(74) *Attorney, Agent, or Firm*—Dirk Brinkman; Gene Vinokur

(57) ABSTRACT

A method generates envelope spectra and harmonic spectra from an input broad-band training acoustic signal. Corresponding non-negative envelope bases are trained for the envelope spectra and non-negative harmonic bases are trained for the harmonic spectra using convolutive non-negative matrix factorization. Higher-band frequencies are generated for an input lower-band acoustic signal according to the non-negative envelope bases and the non-negative harmonic bases. Then, the input lower-band acoustic signal is combined with the higher-band frequencies to produce an output broad-band acoustic signal.

26 Claims, 1 Drawing Sheet

100

CONSTRUCTING BROAD-BAND ACOUSTIC SIGNALS FROM LOWER-BAND ACOUSTIC SIGNALS

FIELD OF THE INVENTION

This invention relates generally to processing acoustic signals, and more particularly to constructing broad-band acoustic signals from lower-band acoustic signals.

BACKGROUND OF THE INVENTION

Broad-band acoustic signals, e.g., speech signals that contain frequencies from a range of approximately 0 kHz to 8 kHz are naturally better sounding and more intelligible than lower-band acoustic signals that have frequencies approximately less than 4 kHz, e.g., telephone quality acoustic. Therefore, it is desired to expand lower-band acoustic signals.

Various methods are known to solve this problem. Aliasing-based methods derive high-frequency components by aliasing low frequencies into high frequencies by various means, Yasukawa, H., "Signal Restoration of Broad Band Speech Using Nonlinear Processing," Proc. European Signal Processing Conf. (EUSIPCO-96), pp. 987-990, 1996.

Codebook methods map a spectrum of the lower-band speech signal to a codeword in a codebook, and then derive higher frequencies from a corresponding high-frequency codeword, Chennoukh, S., Gerrits, A., Miet, G. and Sluijter, R., "Speech Enhancement via Frequency Bandwidth Extension using Line Spectral Frequencies," Proc ICASSP-95, 2001.

Statistical methods utilize the statistical relationship of lower-band and higher-band frequency components to derive the latter from the former. One method models the lower-band and higher-band components of speech as mixtures of random processes. Mixture weights derived from the lower-band signals are used to generate the higher-band frequencies, Cheng, Y. M., O'Shaugnessey, D. O., and Mermelstein, P., "Statistical Recovery of Wideband Speech from Narrow-band Speech," IEEE Trans., ASSP, Vol 2., pp 544-548, 1994.

Methods that use statistical cross-frame correlations can predict higher frequencies. However, those methods are often derived from complex time-series models, such as Gaussian mixture models (GMMs), hidden Markov models (HMMs) or multi-band HMMs, or by explicit interpolation, Hosoki, M., Nagai, T. and Kurematsu, A., "Speech Signal Bandwidth Extension and Noise Removal Using Subband HIGHER-BAND," Proc. ICASSP, 2002.

Linear model methods derive higher-band frequency components as linear combinations of lower-band frequency components, Avendano, C., Hermansky, H., and Wand, E. A., "Beyond Nyquist: Towards the Recovery of Broad-bandwidth Speech from Narrow-bandwidth Speech," Proc. Eurospeech-95, 1995.

SUMMARY OF THE INVENTION

A method estimates high frequency components, e.g., approximately a range of 4-8 kHz, of acoustic signals from lower-band, e.g., approximately a range of 0-4 kHz, acoustic signals using a convolutive non-negative matrix factorization (CNMF).

The method uses input training broad-band acoustic signals to train a set of lower-band and corresponding higher-band non-negative 'bases'. The acoustic signals can be, for example, speech or music. The low-frequency components of these bases are used to determine high-frequency components and can be combined with an input lower-band acoustic signal to construct an output broad-band acoustic signal. The output broad-band acoustic signal is virtually indistinguishable from a true broad-band acoustic signal.

DETAILED DESCRIPTION OF THE PREFERRED EMBODIMENT

Convolutive Non-Negative Matrix Factorization

Figure 1:
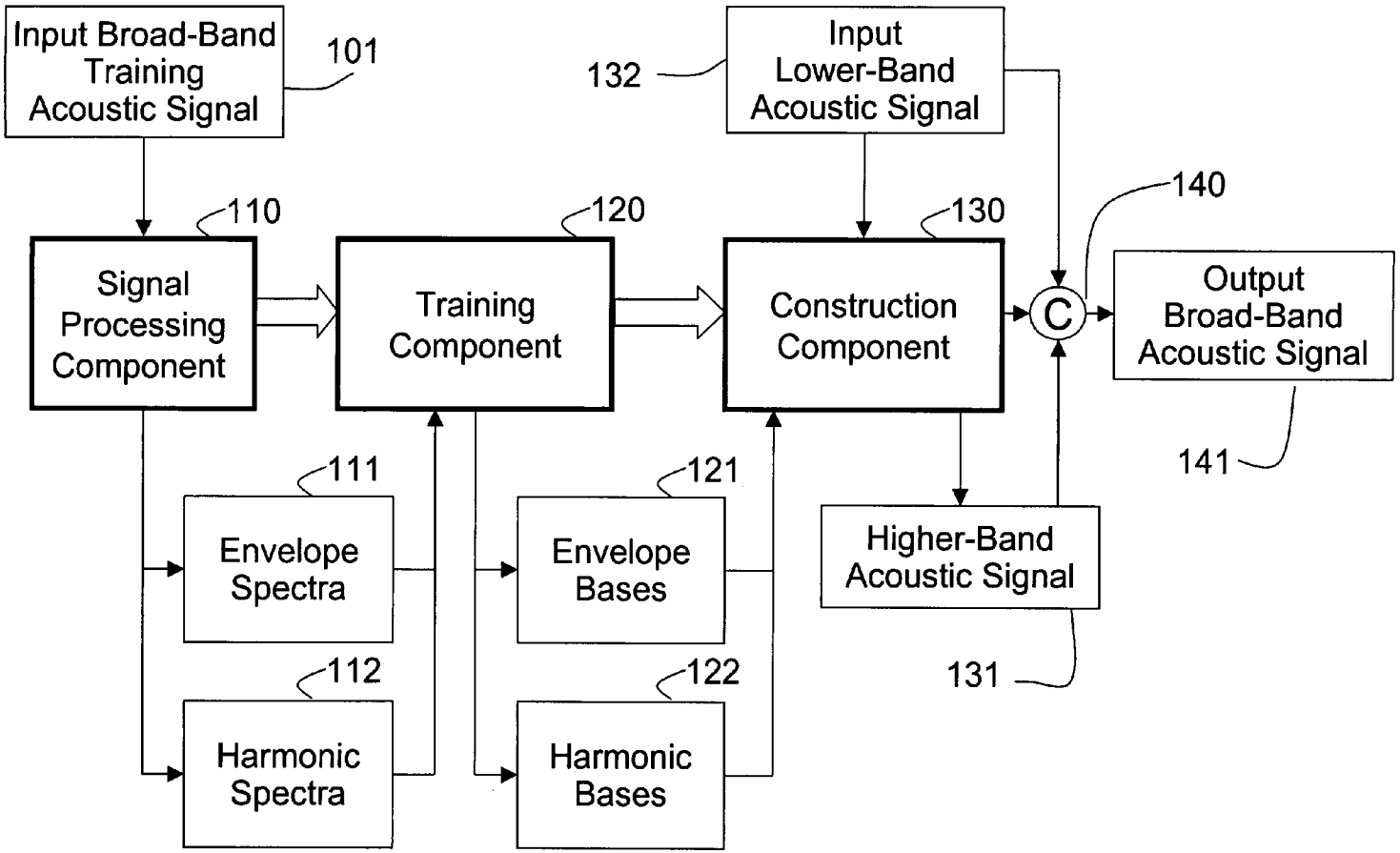
FIG. 1 is a block diagram of a method for expanding an acoustic signal according to one embodiment of the invention.

Matrix factorization decomposes a matrix V into two matrices W and H, such that:

$$V \approx W \cdot H, \tag{1}$$

where W is an M×R matrix, H is a R×N matrix, and R is less than M, while an error of reconstruction of the matrix V from the matrices Wand H is minimized. In such a decomposition, the columns of the matrix W can be interpreted as a set of bases, and the columns of the matrix H as the coordinates of the columns of V, in terms of the bases.

Alternately, the columns of the matrix H represent weights with which the bases in the matrix W are combined to obtain a closest approximation to the columns of the matrix V.

Conventional factorization techniques, such as principal component analysis (PCA) and independent component analysis (ICA), allow the bases to be positive and negative, and the interaction between the terms, as specified by the components of the matrix H, can also be positive and negative.

In strictly non-negative data sets such as matrices that represent sequences of magnitude spectral vectors, neither negative components in the bases nor negative interaction are allowed because the magnitudes of spectral vectors cannot be negative.

One non-negative matrix factorization (NMF) constrains the elements of the matrices W and H to be strictly non-negative, Lee, D. D and H. S. Seung. "Learning the parts of objects with nonnegative matrix factorization," Nature 401, pp. 788-791, 1999. They apply NMF to detect parts of faces in hand-aligned 2D images, and semantic features of summarized text. Another application applies NMF to detect individual notes in acoustic recordings of musical pieces, P. Smaragdis, "Discovering Auditory Objects Through Non-Negativity Constraints," SAPA 2004, October 2004.

The NMF of Lee et al. treats all column bases in the matrix V as a combination of R bases, and assumes implicitly that it is sufficient to explain the structure within individual bases to explain the entire data set. This effectively assumes that the order in which the bases are arranged in the matrix V is irrelevant.

However, these assumptions are clearly invalid in data sets such as sequences of magnitude spectral bases, where structural patterns are evident across multiple bases, and an order in which the bases are arranged is indeed relevant.

Smaragdis describes a convolutive version of the NMF algorithm (CNMF), wherein the bases used to explain the matrix V are not merely singular bases, but actually short sequences of bases. This operation can be symbolically represented as:

$$V \approx \sum_{t=0}^{\tau} W_t^T \cdot \overset{t\rightarrow T}{H}, \tag{2}$$

where each $W_t^T$ is a non-negative M×R matrix, H is a non-negative R×N matrix, as above, the (t→) operator represents a right shift operator that shifts the columns of matrix H by t positions to the right. The T in the superscript of Equation 2 represents a transposition operator. The size of the matrix H is maintained by introducing zero valued columns at the left-most position to account for columns that have been shifted out of the matrix.

We represent the $j^{th}$ vector in $W_t$ as $W_t^j$. Each set of vectors forms a sequence of spectral vectors $w^j$, or a 'spectral patch' in an acoustic signal, e.g., a speech or music signal. These spectral patches form the bases that we use to 'explain' the data in the matrix V.

Equation 2 approximates the matrix V as a superposition of the convolution of these patches with the corresponding rows of the matrix H, i.e., the contribution of $j^{th}$ spectral patch to the approximation of the matrix V is obtained by convolving the patch with the $j^{th}$ row of the matrix H.

If τ=1, then this reduces to the conventional NMF. To estimate the appropriate matrices $W_t$, and the matrix H to estimate the matrix V, we can use the already existing framework of NMF.

We define a cost function as:

$$D = \left\| V \otimes \ln\left(\frac{V}{\Lambda}\right) + \Lambda - V \right\|_F, \tag{3}$$

where the norm on the right side is a Froebinus norm, ⊗ represents a Hadmard component by component multiplication, Λ is the current reconstruction given by the right hand side of Equation 2, using the current estimates of H and the $W_t$ matrices, and F is a lower cutoff frequency, e.g. 4000 Hz. The matrix division to the right is also per-component, and is the approximation to the matrix V given by the right hand side of Equation 2.

The cost function of Equation 3 is a modified Kullback-Leibler cost function. Here, the approximation is given by the convolutive NMF decomposition of Equation 2, instead of the linear decomposition of Equation 1.

Equation 2 can also be viewed as a set of NMF operations that are summed to produce the final result. From this perspective, the chief distinction between Equations 1 and 2 is that the latter decomposes the matrix V into a combination of τ+1 matrices, while the former uses only two matrices.

This interpretation permits us to obtain an iterative procedure for the estimation of the matrices $W_t$ and H matrices by modifying the NMF update equations of Lee et al. The modified iterative update equations are given by:

$$H = H \otimes \frac{\sum_t W_t^T \cdot \left[\overset{\leftarrow t}{\frac{V}{\Lambda}}\right]}{\sum_t W_t^T \cdot 1} \tag{4}$$

-continued $$W_t = W_t \otimes \frac{\left[\frac{V}{\Lambda}\right] \cdot \overset{t\rightarrow T}{H}}{1 \cdot \overset{t\rightarrow T}{H}} \tag{5}$$

where ⊗ represents a component-by-component Hadamard multiplication, and the division operations are also component-into-component. The (←t) operator represents a left shift operator, the inverse of to the right shift operator in Equation 2. The overall procedure for estimating the $W_t$ and H matrices, thus, is as follows:

Initialize all matrices, e.g., use a random initialization, thereafter iteratively update all terms using Equations 4 and 5.

The spectral patches $W^j$, comprising the $j^{th}$ columns of all the matrices $W_t^j$ trained by the CNMF, represent salient spectrographic structures in the acoustic signal.

When applied to speech signals as described below, the trained bases represent relevant phonemic or sub-phonetic structures.

Constructing High Frequency Structures of a Band Limited Acoustic Signal

As shown in FIG. 1, a method 100 for constructing higher-band frequencies for a narrow-band signal includes the following components:

A signal processing component 110 generates, from an input broad-band training acoustic signal 101, representations for low-resolution spectra and high-resolution spectra, hereinafter 'envelope spectra' 111, and the 'harmonic spectra' 112, respectively.

A training component 120 trains corresponding non-negative envelope bases 121 for the envelope spectra, and non-negative harmonic bases 122 for the harmonic spectra using the convolutive non-negative matrix factorization.

A construction component 130 constructs higher-band frequencies 131 for an input lower-band acoustic signal 132, which are then combined 140 to produce an output broad-band acoustic signal 141.

Signal Processing

A sampling rate for all of the acoustic signals is sufficient to acquire both lower-band and higher-band frequencies. Signals sampled at lower frequencies are upsampled to this rate. We use a sampling rate of 16 kHz, and all window sizes and other parameters described below are given with reference to this sampling rate.

We determine a short-time Fourier transform of the acoustic signals using a Hanning window of 512 samples (32 ms) for each frame, with an overlap of 256 samples between adjacent frames, timed-synchronously with the corresponding input broad-band training acoustic signal.

A matrix S represent a sequence of complex Fourier spectra for the acoustic signal, a matrix Φ represent the phase, and a matrix V represents the component-wise magnitude of the matrix S. Thus, the matrix V represents the magnitude spectrogram of the signal.

In the matrices V and Φ, each column represents respectively the magnitude spectra and phase of a single 32 ms frame of the acoustic signal. If there are M unique samples in the Fourier spectrum for each frame, and there are N frames in the signal, then the matrices V and Φ are M×N matrices.

We determine the envelope spectra 111 and the harmonic spectra 112 of the training acoustic signal 101 by cepstral weighting or 'liftering' the matrix V. The matrix $V_e$ represents the sequence of envelope spectra derived from the matrix V, and the matrix $V_h$ represents the sequence of corresponding harmonic spectra. The matrices $V_e$ and $V_h$ are both M×N matrices derived from the matrix V according to:

$$V_h=\exp(\mathrm{IDCT}(\mathrm{DCT}((\log(V))\otimes Z_h))) \quad (6)$$

$$V_e=\exp(\mathrm{IDCT}(\mathrm{DCT}((\log(V))\otimes Z_e))) \quad (7)$$

The matrix $Z_e$ has the lower K frequency components of each row are set to one, and the rest of the frequency components are set to zero. The matrix $Z_h$ has the higher frequency components set to one and the rest of the frequency components set to zero, i.e., $$Z_h=1-Z_e.$$

The discrete cosine transform (DCT) and the inverse DCT operations in Equations 6 and 7 are applied separately to each row of the respective matrix arguments.

With an appropriate selection of the lower frequency K components, e.g., K=M/3, the matrices $V_e$ and $V_h$ model the structure of the envelope spectra and harmonic spectra of the training signal 101.

Lower frequencies of the envelope spectra of the lower-band portion of the training acoustic signal, and upper frequencies of the envelope spectra of the training acoustic signal can be combined to compose a synthetic envelope spectral matrix. Similarly, lower frequencies of the harmonic spectra of the lower-band training signal, and upper frequencies of the harmonic spectra of the input broad-band training signal can be combined to compose a synthetic harmonic spectral matrix.

Training Spectral Bases

The first stage of the training step 120 trains the matrices $V_e$, $V_h$, and Φ from the training signal 101. The training signal can be speaker dependent or speaker independent, because characteristics of any speaker or group of speakers can be acquired by relatively short signals, e.g., five minutes or less.

The matrices are obtained in a two-step process. In the first step, the training signal is filtered to a frequency band expected in the lower-band acoustic signal 132, and then down-sampled to an expected sampling rate of the lower-band signal 132, and finally upsampled to the sampling rate of the higher-band signal 131. This signal is a close approximation to the signals that is obtained by up-sampling the lower-band signal.

Harmonic, envelope and phase spectral matrices $V_h^n$, $V_e^n$, and $\Phi^n$ are obtained from the upsampled lower-band training signal.

Envelope, harmonic and phase spectral matrices $V_e^w$, $V_h^w$ and $\Phi^w$ are derived from the wide-band training signal 101. The matrices $V_h$, $V_e$ and Φ are formed from frequency components less than a predetermined cutoff frequency F, from the spectral matrices for the lower-band, and the higher frequency components of the matrices derived from the broad-band signal as:

$$V_e=Z_wV_e^w+Z_nV_e^n$$

$$V_h=Z_wV_h^w+Z_hV_e^n$$

$$\Phi=Z_w\Phi^w+Z_n\Phi^n \quad (8)$$

The matrix $Z_w$ is a square matrix with the first diagonal elements set to one and the remaining elements set to zero. The matrix $Z_n$ is also a square matrix with the last diagonal elements set to one and the remaining elements set to zero. The parameter L is a frequency index that corresponds to the cutoff frequency F.

The spectral patch bases $W_t^e$ for $t=1,\ldots,\tau_e$ are derived for the envelope spectra $V_e$ using the iterative update process specified by Equations 4 and 5. The matrix H is discarded.

The set of lower-band spectral envelope bases, $W_t^{e,l}$ derived from the envelope spectra $V_e$, are obtained by truncating all the matrices at the $L^{th}$ row, such that each of the resulting matrices is of size L×R:

$$W_t^{e,l}=Z_LW_t^e \quad (9)$$

The matrix $Z_L$ is a L×M matrix, where the L leading diagonal elements are one, and the remaining elements are zero.

The set of lower-band spectral harmonic bases, $W_t^{h,l}$ are obtained similarly. The set of matrices, $W_t^e$, $W_t^{l,t}$, $W_t^h$ form the spectral patch bases to be used for construction.

The phase matrix Φ is separated into a L×N low-frequency phase matrix $\Phi_l$ and a M−(L×N) high-frequency matrix $\Phi_u$.

A linear regression between the matrices is obtained:

$$A_\Phi=\Phi_u\cdot\mathrm{pseudoinverse}(\Phi_h) \quad (10)$$

Constructing Broad-Band Acoustic Signals

The input lower-band acoustic signal 132 is upsampled to the sampling rate of the broad-band training signal 101, and the phase, envelope and harmonic spectral matrices Φ, $V_h$, and $V_e$, are derived from upsampled signal. The lower frequency components of the matrices are separated out as $V_e=Z_LV_e$ and $V_h=Z_LV_h$.

CNMF approximations are obtained for the matrices $V_e^l$ and $V_h^l$, based on the $W_t^{e,l}$ and $W_t^{h,l}$ bases obtained from the training signal. This approximates $V_e^l$ and $V_h^l$ as:

$$V_h^l \approx \sum_{t=0}^{\tau_h} (W_t^{h,l})^T\cdot\overset{t\to T}{(H_h)} \text{ and } V_e^l \approx \sum_{t=0}^{\tau_e} (W_t^{e,l})^T\cdot\overset{t\to T}{(H_e)} \quad (11)$$

The $H_h$ and $H_e$ matrices are obtained through iterations of Equation 4.

Then, broad-band spectrograms are constructed by applying the estimated matrices $H_h$ and $H_e$ to the complete bases $W_t^e$ and $W_t^h$ obtained by the training:

$$\overline{V}_h = \sum_{t=0}^{\tau_h} (W_t^h)^T\cdot\overset{t\to T}{(H_h)} \text{ and } \overline{V}_e = \sum_{t=0}^{\tau_e} (W_t^e)^T\cdot\overset{t\to T}{(H_e)} \quad (12)$$

The higher-band frequencies 131 and input lower-band frequencies 132 are obtained according to:

$$\hat{V}_h=Z_w\overline{V}_h+Z_hV_h \text{ and } \hat{V}_e=Z_w\overline{V}_e+Z_eV_e. \quad (13)$$

The complete magnitude spectrum for the output broad-band signal 141 is obtained as a combination (C):

$$\hat{V}=\hat{V}_h\otimes\hat{V}_e.$$

A phase for output the broad-band signal is:

$$\hat{\Phi}=(Z_h+Z_U\cdot A_\Phi Z_L) \quad (14)$$

where $Z_U$ is a M×L matrix, with (M−L) leading diagonal elements set to one, and the remaining elements set to zero.

Then, the complete output broad-band signal 141 is obtained by determining an inverse short-time Fourier transform of $\hat{V}e^{j\Phi}$.

Although the invention has been described by way of examples of preferred embodiments, it is to be understood that various other adaptations and modifications may be made within the spirit and scope of the invention. Therefore, it is the object of the appended claims to cover all such variations and modifications as come within the true spirit and scope of the invention.

We claim:

1. A method for constructing a broad-band acoustic signal from a lower-band acoustic signal, comprising:

generating envelope spectra and harmonic spectra from an input broad-band training acoustic signal;

generating corresponding non-negative envelope bases for the envelope spectra and non-negative harmonic bases for the harmonic spectra using convolutive non-negative matrix factorization;

generating higher-band frequencies for an input lower-band acoustic signal according to the non-negative envelope bases and the non-negative harmonic bases; and combining the input lower-band acoustic signal with the generated higher-band frequencies to produce an output broad-band acoustic signal.

2. The method of claim 1, in which the input broad-band training acoustic signal and the input lower-band acoustic signal are speaker dependent.

3. The method of claim 1, in which the input broad-band training acoustic signal and the input lower-band acoustic signal are speaker independent.

4. The method of claim 1, in which the input broad-band training acoustic band signal and the output broad-band acoustic signal include frequencies in a range of approximately 0 khZ to 8 kHz, and the input lower-band acoustic signal includes frequencies in a range of approximately 0 kHz to 4 kHz, and the higher-band acoustic signal includes frequencies approximately in a range of 4 kHz to 8 kHz.

5. The method of claim 1, in which a sampling rate for the input broad-band training acoustic signal is sufficient to acquire both the lower-band and higher-band frequencies.

6. The method of claim 5, in which the input broad-band training signal is low-pass filtered to a frequency expected in the lower-band acoustic signal, and further comprising:

downsampling the low-pass filtered signal to a lower sampling rate; and upsampling the downsampled signal back to the sampling rate of the input broadband training acoustic signal, to generate a lower-band training acoustic signal.

7. The method of claim 5, further comprising:

determining a short-time Fourier transform of the input broad-band training acoustic signal using a Hanning window of 512 samples for each frame, with an overlap of 256 samples between adjacent frames, and in which, for the input broad-band training acoustic signal, a matrix S represents a sequence of complex Fourier spectra, a matrix $\Phi^w$ represents a phase, and a matrix $V^w$ represents a component-wise magnitude of the matrix S such that the matrix $V^w$ represents a magnitude spectrogram of the input broad-band training acoustic signal.

8. The method of claim 7, in which the input broad-band training acoustic signal includes M unique samples in the Fourier spectrum for each frame, and there are N frames in the an input broad-band training acoustic signal, and the matrices $V^w$ and $\Phi^w$ are M×N matrices.

9. The method of claim 8, further comprising:

determining the envelope spectra and the harmonic spectra of the input broad-band training acoustic signal by cepstral weighting of the matrix $V^w$.

10. The method of claim 6, further comprising:

determining a short-time Fourier transform of the lower-band training acoustic signal using a Hanning window of 512 samples for each frame, with an overlap of 256 samples between adjacent frames, timed-synchronously with the corresponding input broad-band training acoustic signal.

11. The method of claim 10, in which the input lower-band training acoustic signal includes M unique samples in a Fourier spectrum for each frame, and there are N frames in the lower-band training acoustic signal, resulting in an M×N spectral matrix, from which a matrix $\Phi^n$ representing a phase, and a matrix $V^n$ representing a component-wise magnitude are derived.

12. The method of claim 11, further comprising:

determining the envelope spectra and the harmonic spectra of the lower-band training acoustic signal by cepstral weighting of the matrix $V^n$.

13. The method of claims 9 or 12, further comprising:

combining lower frequencies of the envelope spectra of the lower-band training acoustic signal, and upper frequencies of the envelope spectra of the input broad-band training acoustic signal to compose a synthetic envelope spectral matrix.

14. The method of claim 13, further comprising:

learning non-negative envelope bases for the synthetic envelope spectral matrix.

15. The method of claims 9 or 12, further comprising:

combining lower frequencies of the harmonic spectra of the lower-band training signal, and upper frequencies of the harmonic spectra of the input broad-band training signal to compose a synthetic harmonic spectral matrix.

16. The method of claim 15, further comprising:

learning non-negative harmonic bases for the synthetic harmonic spectral matrix.

17. The method of claims 8 or 11, in which a linear transformation $A_\Phi$ is determined between lower frequencies of the matrix $\Phi^w$ and upper frequencies of the matrix $\Phi^w$.

18. The method of claim 1, further comprising:

upsampling the input lower-band acoustic signal to a sampling frequency of the input broad-band training acoustic signal.

19. The method of claim 18, further comprising determining a short-time Fourier transform of the input lower-band acoustic signal using a Hanning window of 512 samples for each frame, with an overlap of 256 samples between adjacent frames to generate a Fourier spectral matrix; and deriving an envelope spectrum and a harmonic spectrum from the Fourier spectral matrix by cepstral weighting.

20. The methods of claim 14, further comprising:

deriving optimal weights of the non-negative envelope bases from the envelope spectrum of the input lower-band acoustic signal.

21. The method of claim 20, further comprising:

combining the upper frequencies of the envelope bases with the optimal weights to derive a reconstructed upper-frequency envelope spectrum.

22. The method of claim 16, further comprising:

deriving optimal weights of the non-negative harmonic bases from the harmonic spectrum of the input lower-band acoustic signal.

23. The method of claim 22, further comprising:

combining the upper frequencies of the harmonic bases with the optimal weights to derive a reconstructed upper-frequency harmonic spectrum.

24. The method of claim 21, further comprising:

multiplying the reconstructed upper-frequency envelope and harmonic spectra to derive a reconstructed upper-frequency magnitude spectrum.

25. The methods of claims 17, further comprising:

multiplying a phase of the lower frequencies of the lower-band signal by the linear transformation $A_{\Phi}$ to derive a reconstructed phase of the upper-frequency magnitude spectrum.

26. The methods of 24, further comprising:

combining the reconstructed phase and magnitude of the upper-frequency magnitude spectrum;

determining an inverse Fourier transform to derive the upper frequency signal; and combining the upper frequency signal with the input lower-band signal to produce an output broad-band acoustic signal.

* * * * *